US008282194B2

(12) United States Patent
Ozawa

(10) Patent No.: US 8,282,194 B2
(45) Date of Patent: Oct. 9, 2012

(54) LIQUID EJECTING HEAD AND LIQUID EJECTING APPARATUS

(75) Inventor: Kinya Ozawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 197 days.

(21) Appl. No.: 12/889,239

(22) Filed: Sep. 23, 2010

(65) Prior Publication Data

US 2011/0074883 A1 Mar. 31, 2011

(30) Foreign Application Priority Data

Sep. 30, 2009 (JP) ..... 2009-226337

(51) Int. Cl.
*B41J 2/14* (2006.01)

(52) U.S. Cl. ..... 347/47

(58) Field of Classification Search ..... 347/40, 347/43, 47, 65–68
See application file for complete search history.

(56) References Cited

U.S. PATENT DOCUMENTS

| | | | | |
|---|---|---|---|---|
| 7,137,680 | B2 | 11/2006 | Mataki | |
| 7,399,060 | B2 * | 7/2008 | Tsuchii | 347/47 |
| 7,524,036 | B2 * | 4/2009 | Mataki | 347/65 |
| 2004/0080574 | A1 | 4/2004 | Masumi | |

FOREIGN PATENT DOCUMENTS

| | | |
|---|---|---|
| JP | 2004-090223 | 3/2004 |
| JP | 2005-119296 | 5/2005 |

OTHER PUBLICATIONS

Zheng Wu and Michael Sayer "Defect Structures and Fatigue in Ferroelectric PZY Thin Films" Proceedings of the Eighth IEEE International Symposium on Applications of Ferroelectrics, 1992. ISAF '92., Aug. 30-Sep. 2, 1992 Location: Greenville, SC, on pp. 244-247.

* cited by examiner

*Primary Examiner* — Lamson Nguyen
(74) *Attorney, Agent, or Firm* — Workman Nydegger

(57) ABSTRACT

A liquid ejecting head includes nozzles that eject liquid, pressurizing chambers communicating with respective nozzles, and liquid supply channels that supply the liquid to the pressurizing chambers. The liquid ejecting head ejects the liquid when a pressure generating unit changes the pressure within the pressurizing chambers. A cylindrical nozzle straight portion, in which the opening cross-sectional area is narrower than at other areas of the nozzle, is formed toward the pressurizing chamber from the nozzle opening in each nozzle. The opening cross-sectional area of the nozzle straight portion is Sn; the length thereof is Ln; the channel cross-sectional area of the liquid supply channel is Ss; the length from a common liquid chamber-side connection opening in the liquid supply channel to a pressurizing chamber-side connection opening is Ls. The ratio (Ln/Sn) is less than or equal to ½ of the ratio (Ls/Ss).

6 Claims, 6 Drawing Sheets

FIG. 6A

[UNIT]: μm

| | | INK SUPPLY CHANNEL d=80, w=60 | | | | |
|---|---|---|---|---|---|---|
| | | Ls=500 | Ls=520 | Ls=550 | Ls=600 | Ls=700 |
| NOZZLE OPENING DIAMETER 20 | Ln=15 | ○ | ○ | ○ | ○ | ○ |
| | Ln=20 | △ (LONG TAIL) | △ (LONG TAIL) | △ (LONG TAIL) | △ (LONG TAIL) | ○ |
| | Ln=25 | × (INEFFICIENT EJECTION) | × (INEFFICIENT EJECTION) | × (INEFFICIENT EJECTION) | △ (LONG TAIL) | △ (LONG TAIL) |
| | Ln=30 | × (INEFFICIENT EJECTION) | × (INEFFICIENT EJECTION) | × (INEFFICIENT EJECTION) | × (INEFFICIENT EJECTION) | × (INEFFICIENT EJECTION) |

FIG. 6B

[UNIT]: μm

| | | INK SUPPLY CHANNEL d=80, w=60 | | | | |
|---|---|---|---|---|---|---|
| | | Ls=500 | Ls=520 | Ls=550 | Ls=600 | Ls=700 |
| NOZZLE OPENING DIAMETER 22 | Ln=15 | ○ | ○ | ○ | ○ | ○ |
| | Ln=20 | △ (LONG TAIL) | ○ | ○ | ○ | ○ |
| | Ln=25 | △ (LONG TAIL) | △ (LONG TAIL) | △ (LONG TAIL) | △ (LONG TAIL) | ○ |
| | Ln=30 | × (INEFFICIENT EJECTION) | × (INEFFICIENT EJECTION) | × (INEFFICIENT EJECTION) | × (INEFFICIENT EJECTION) | △ (LONG TAIL) |

FIG. 6C

[UNIT]: μm

| | | INK SUPPLY CHANNEL d=80, w=60 | | | | |
|---|---|---|---|---|---|---|
| | | Ls=500 | Ls=520 | Ls=550 | Ls=600 | Ls=700 |
| NOZZLE OPENING DIAMETER 24 | Ln=15 | ○ | ○ | ○ | ○ | ○ |
| | Ln=20 | ○ | ○ | ○ | ○ | ○ |
| | Ln=25 | △ (LONG TAIL) | △ (LONG TAIL) | △ (LONG TAIL) | △ (LONG TAIL) | ○ |
| | Ln=30 | × (INEFFICIENT EJECTION) | × (INEFFICIENT EJECTION) | × (INEFFICIENT EJECTION) | × (INEFFICIENT EJECTION) | △ (LONG TAIL) |

LIQUID EJECTING HEAD AND LIQUID EJECTING APPARATUS

The entire disclosure of Japanese Patent Application No. 2009-226337, filed Sep. 30, 2009 is expressly incorporated by reference herein.

BACKGROUND

1. Technical Field

The present invention relates to a liquid ejecting head such as an ink jet-type recording head and a liquid ejecting apparatus provided with such a liquid ejecting head, and particularly relates to a liquid ejecting head and a liquid ejecting apparatus capable of handling high-viscosity liquids.

2. Related Art

A liquid ejecting apparatus is an apparatus that includes a liquid ejecting head capable of ejecting a liquid and that ejects various types of liquid from the liquid ejecting head, causing those liquids to impact upon an impact target. An image recording apparatus such as an ink jet printer (called simply a "printer" hereinafter) that is, for example, provided with an ink jet-type recording head (an example of a liquid ejecting head; called simply a "recording head" hereinafter), and that records images, text, and so on a printing medium such as recording paper, the printing surface of an optical disc, or the like (an example of an impact target) by causing ink in liquid form to be ejected from nozzles in the recording head and impact upon the printing medium, can be given as an example of a typical liquid ejecting apparatus. Meanwhile, in addition to such image recording apparatuses, the ink jet techniques of liquid ejecting apparatuses are recently being applied in various other manufacturing apparatuses as well, such as apparatuses for manufacturing color filters for liquid crystal displays, electrode forming apparatuses, and so on.

The aforementioned liquid ejecting apparatus is sometimes used in applications where the liquid that is ejected has a viscosity of 8 mPa·s or more (called a "high-viscosity liquid" hereinafter). For example, high-viscosity inks are advantageous in that they are less prone to bleeding than low-viscosity inks (that is, inks with a viscosity of less than 8 mPa·s); thus, not only is unevenness in the darkness unlikely to occur in the recorded image, but the ink also dries quickly. Ultraviolet light-curable inks, liquid crystals, and so on that are cured by irradiating the liquid with ultraviolet light are also examples of high-viscosity liquids.

Meanwhile, with such liquid ejecting apparatuses, while it is desirable to eject large ink droplets in order to accelerate so-called solid printing, in which a predetermined region of the recording medium is filled with ink, text printing, in which text characters are printed, and so on, it is also desirable to eject small ink droplets in order to meet the demand for increased resolutions in recorded images and the like. Accordingly, limiting the dimensions of nozzle diameters to a specific range in which small ink droplets can be ejected and furthermore limiting the ejecting amount of the ink droplets to an ejection amount that is within a specific range has been proposed (for example, see JP-A-2004-090223). Attempting to miniaturize ink droplets by employing a configuration in which geometrical conditions in a recording head are met and the meniscus of high-viscosity ink is prevented from vibrating naturally has also been proposed (for example, see JP-A-2005-119296).

Incidentally, when the high-viscosity liquids are ejected using a liquid ejecting apparatus, it is more difficult for the liquid to move within the nozzle and the liquid ejection is prone to drops in efficiency, as compared to the ejection of low-viscosity liquids. Furthermore, when liquid droplets are actually ejected, there is a tendency for the portion of the ejected droplet at the rear of the flight direction to extend as a tail (this phenomenon will be referred to as "trailing tails" hereinafter). If trailing tails occur, there is the possibility that the impact shape (dot shape) on the impact target will be disrupted. In other words, a circle, an ellipse, or the like of a target size is desirable as the impact shape from the standpoint of image quality or device capabilities; however, there has been a problem in that if the liquid droplet impacts in a state in which the tail portion is protruding from the main impacted portion of the droplet, the impact shape will be a distorted shape, rather than a circle or an ellipse. Meanwhile, in the case where all or part of the tail separates from the primary droplet as mist (satellite droplets), there is the possibility that that mist will impact upon the impact target in a different position than the primary droplet. Such disturbance in the impact shape is a cause of image quality degradation when, for example, an image is recorded onto recording paper by a printer.

SUMMARY

An advantage of some aspects of the invention is to provide a liquid ejecting head and a liquid ejecting apparatus capable of suppressing image quality degradation by suppressing the occurrence of trailing tails, mist, and so on, and capable of suppressing a drop in the ejection efficiency of liquid droplets, when ejecting a high-viscosity liquid.

An aspect of the invention is a liquid ejecting head including multiple nozzles from which a liquid is ejected, pressurizing chambers communicating with respective nozzles, and liquid supply channels that supply the liquid from a common liquid chamber to the respective pressurizing chambers, the liquid ejecting head ejecting the liquid held in the pressurizing chambers from nozzle openings in the tips of the nozzles when a change in the pressure within the pressurizing chambers is instigated by driving a pressure generation unit. Here, the inertance of the nozzles is set to be less than the inertance of the liquid supply channels; a cylindrical nozzle straight portion, in which the opening cross-sectional area is set to be narrower than the other areas of the nozzle, is formed toward the pressurizing chamber from the nozzle opening in each nozzle; the opening cross-sectional area of the nozzle straight portion is a straight surface area Sn; the length of the nozzle straight portion is a straight length Ln; the channel cross-sectional area of the liquid supply channel is a supply channel surface area Ss; the length from a common liquid chamber-side connection opening in the liquid supply channel to a pressurizing chamber-side connection opening is a supply channel length Ls; and the ratio of the straight length Ln to the straight surface area Sn (Ln/Sn) is set so as to be less than or equal to ½ of the ratio of the supply channel length Ls to the supply channel surface area Ss (Ls/Ss).

According to this configuration, the inertance of the nozzles is set to be less than the inertance of the liquid supply channels; a cylindrical nozzle straight portion, in which the opening cross-sectional area is set to be narrower than the other areas of the nozzle, is formed toward the pressurizing chamber from the nozzle opening in each nozzle; the opening cross-sectional area of the nozzle straight portion is a straight surface area Sn; the length of the nozzle straight portion is a straight length Ln; the channel cross-sectional area of the liquid supply channel is a supply channel surface area Ss; the length from a common liquid chamber-side connection opening in the liquid supply channel to a pressurizing chamber-side connection opening is a supply channel length Ls; and the ratio of the straight length Ln to the straight surface area Sn (Ln/Sn) is set so as to be less than or equal to ½ of the ratio of the supply channel length Ls to the supply channel surface area Ss (Ls/Ss). Accordingly, problems in which trailing tails, mist, or the like occur can be suppressed even if high-viscosity liquid is used, and thus an impact shape of ink droplets on the impact target that is closer to an ideal shape can be realized. Through this, for example, a sense of graininess (where fine dots appear visible throughout the image) visually perceived by a viewer of a recorded image that has been recorded onto the printing surface of recording paper or the like can be suppressed, which can contribute to an improvement in the image quality in an ink jet-type recording apparatus. In addition, the channel resistance in the nozzle is not increased, thus making it possible to avoid an increase in pressure loss in the liquid when ejecting the liquid from the nozzle and, by extension, a dramatic drop in the efficiency of operations when ejecting liquid (that is, the ejection efficiency).

In the aforementioned configuration, a nozzle taper portion whose opening cross-sectional area progressively increases in the direction of the pressurizing chamber more toward the pressurizing chamber than the nozzle straight portion in the nozzle is formed so as to communicate with the nozzle straight portion; and it is desirable for the angle of aperture of the nozzle taper portion to be set greater than or equal to 40 degrees.

According to this configuration, the nozzle taper portion is provided so as to communicate with the nozzle straight portion, which makes it possible to conduct the liquid from the pressurizing chamber into the nozzle straight portion in a smooth manner, thus making it possible to achieve an improvement in the liquid ejection efficiency.

Furthermore, in the aforementioned configuration, it is desirable for the viscosity of the liquid in the pressurizing chamber to be greater than or equal to 8 mPa·s.

According to this configuration, the viscosity of the liquid in the pressurizing chamber is greater than or equal to 8 mPa·s, and thus a problem in which the liquid droplet spreads out excessively upon the impact target can be suppressed, thus making it possible to achieve a liquid droplet impact shape that is even closer to an ideal state. For example, when recording an image or the like on the printing surface of recording paper or the like in an ink jet-type recording apparatus, liquid droplets can be made less prone to bleeding on the recording paper, which makes it possible to suppress the occurrence of unevenness in the darkness of the recorded image.

A liquid ejecting apparatus according to another aspect of the invention includes a liquid ejecting head having one of the aforementioned configurations.

BRIEF DESCRIPTION OF THE DRAWINGS

The invention will be described with reference to the accompanying drawings, wherein like numbers reference like elements.

FIGS. 6A to 6C are tables illustrating quality judgments of ink ejection states.

DESCRIPTION OF EXEMPLARY EMBODIMENTS

Hereinafter, an embodiment of the invention will be described with reference to the appended drawings. Although various limitations are made in the embodiment described hereinafter in order to illustrate a specific preferred example of the invention, it should be noted that the scope of the invention is not intended to be limited to this embodiment unless such limitations are explicitly mentioned hereinafter. An ink jet recording apparatus (referred to as a "printer") will be given hereinafter as an example of a liquid ejecting apparatus according to the invention.

Figure 1:
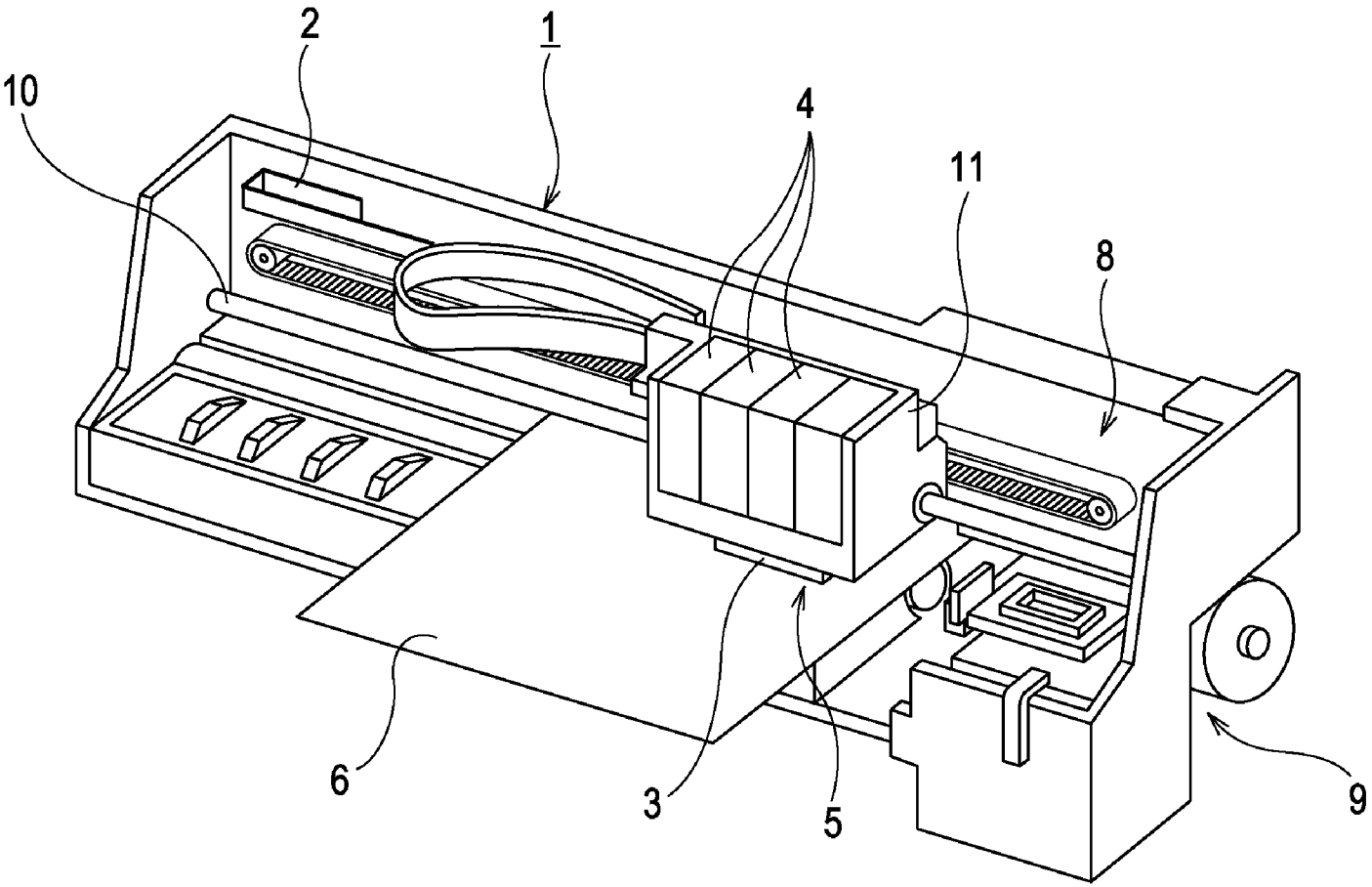
FIG. 1 is a perspective view illustrating the configuration of a printer.

FIG. 1 is a perspective view illustrating the configuration of a printer 1. This printer 1 is generally configured of a carriage 5 in which a recording head 3 (an example of a "liquid ejecting head" according to the invention) and an ink cartridge 4 are installed, a carriage movement mechanism 8 that causes the carriage 5 (the recording head 3) to move back and forth in the paper width direction of a recording paper 6 (an example of a "recording medium"), or in other words, in the main scanning direction, and a paper feed mechanism 9 that transports the recording paper 6 in the sub scanning direction, which is orthogonal to the main scanning direction; these elements are provided within a housing 2.

The carriage 5 is axially supported by a guide rod 10 that is mounted within the housing 2 in the main scanning direction, and the configuration is such that the carriage 5 moves in the main scanning direction along the guide rod 10 as a result of operations performed by the carriage movement mechanism 8. A cartridge attachment portion 11 is provided in the upper portion of the carriage 5, and the ink cartridge 4, which supplies ink to the recording head 3, can be attached and detached to the cartridge attachment portion 11. Furthermore, the recording head 3 is attached to the lower portion of the carriage 5 so as to oppose the upper surface of the recording paper 6.

Figure 2:
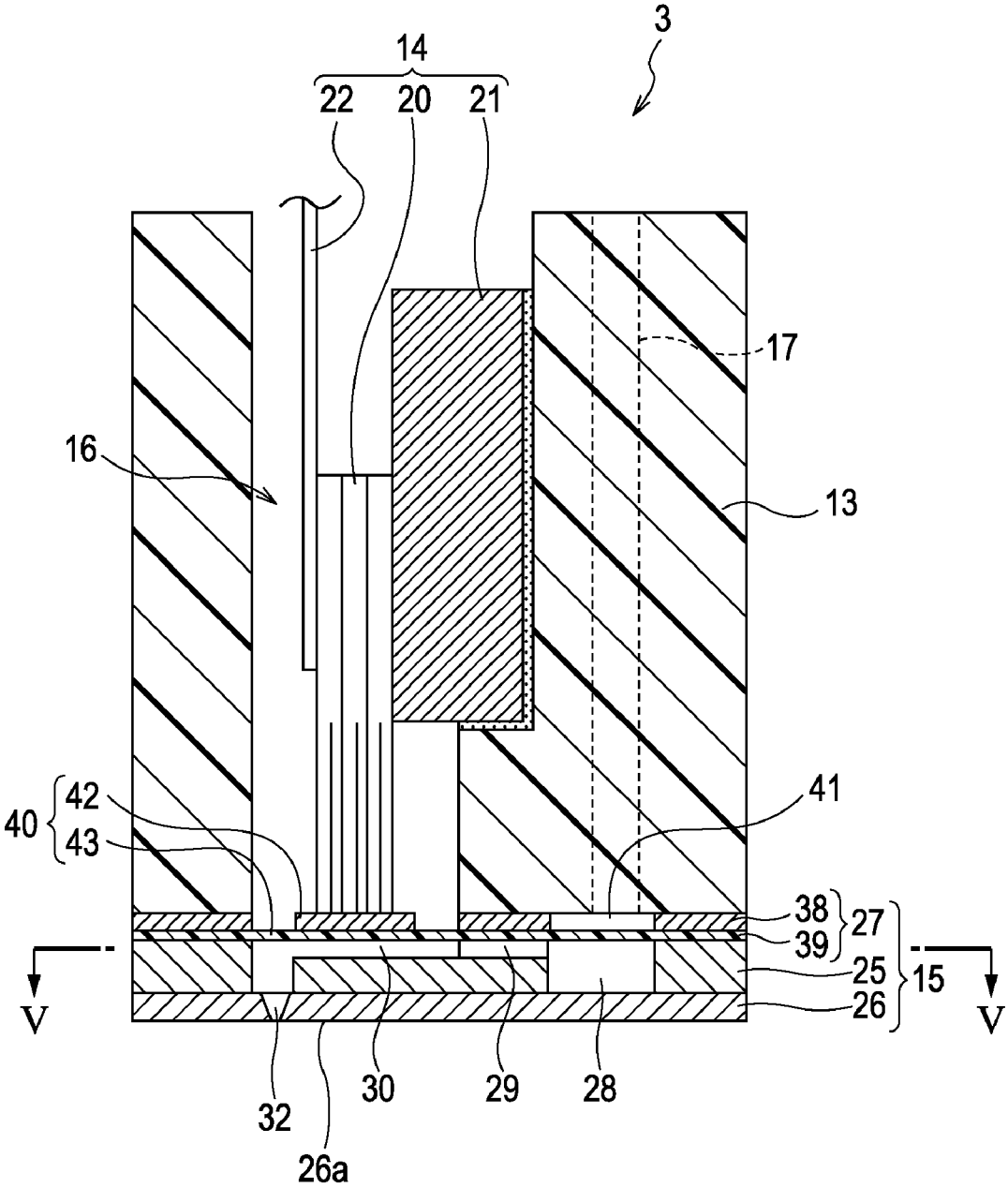
FIG. 2 is a cross-sectional view of the principal constituent elements illustrating the configuration of a recording head.
Figure 3:
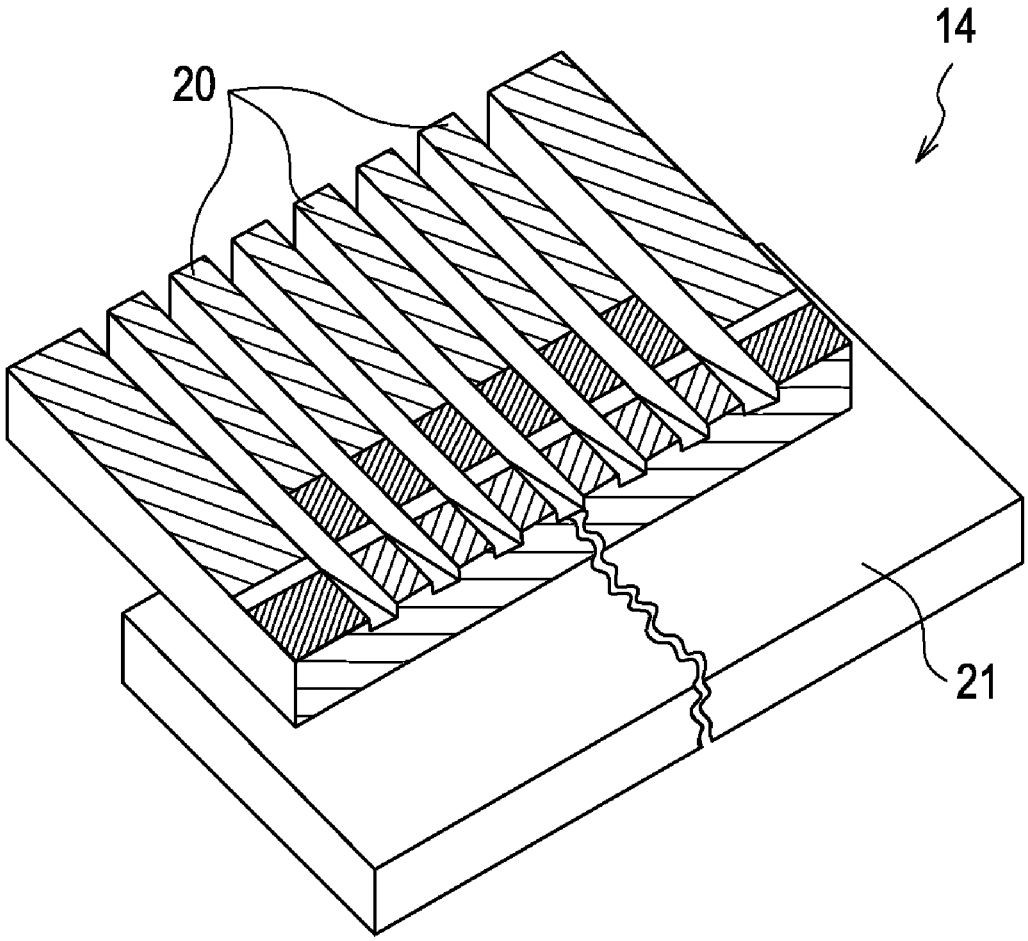
FIG. 3 is a perspective view illustrating the configuration of a vibrator unit.

FIG. 2 is a cross-sectional view of the principal constituent elements illustrating the configuration of the stated recording head 3. The recording head 3 includes a case 13, a vibrator unit 14 that is housed within the case 13, a flow channel unit 15 that is bonded to the bottom surface (the end surface) of the case 13, and so on. The case 13 is created using, for example, an epoxy resin; a housing cavity 16 for housing the vibrator unit 14 and a case flow channel 17 for conducting ink from the ink cartridge 4 into the flow channel unit 15 are formed within the case 13. The vibrator unit 14 includes a piezoelectric vibrator 20 that functions as a type of pressure generation unit, an anchor plate 21 that is bonded to the piezoelectric vibrator 20, and a flexible cable 22 for supplying driving signals and the like to the piezoelectric vibrator 20. Note that the piezoelectric vibrator 20 is, as shown in FIG. 3, a stacked-type piezoelectric element in which a piezoelectric plate formed by stacking piezoelectric layers and electrode layers in alternation with each other is cut into a comb-tooth shape, and is driven in a longitudinal vibration mode that enables the piezoelectric element to expand and contract in the direction (electric field direction) orthogonal to the stacking direction (electric field transverse effect type).

The flow channel unit 15 is configured by bonding a nozzle plate 26 to one surface of a flow channel formation substrate 25 and a vibrating plate 27 to the other surface of the flow channel formation substrate 25. A reservoir 28 (corresponding to a "common liquid chamber" according to the invention), ink supply channels 29 (corresponding to a "liquid supply channel" according to the invention), pressurizing chambers 30, and nozzles 32 are provided in the flow channel unit 15. The configuration is such that the ink supply channels 29 connect the reservoir 28 and the pressurizing chambers 30, the case flow channel 17 connects the reservoir 28 and the ink cartridge 4, and the ink within the ink cartridge 4 is conducted from the case flow channel 17 to the reservoir 28 and is further supplied to the pressurizing chambers 30 through the ink supply channels 29. The nozzles 32 are connected to their corresponding pressurizing chambers 30 on the opposite side as the ink supply channels 29, and ink that has filled the pressurizing chambers 30 is capable of being ejected from the nozzles 32. Multiple serial ink channels that extend from respective ink supply channels 29, through the pressurizing chambers 30, and to the nozzles 32 are formed corresponding to the number of nozzles 32 that are formed.

The nozzle plate 26 is a thin plate made of a metal such as stainless steel, in which multiple nozzles 32 have been opened in row form at a pitch corresponding to the dot formation density (for example, 180 dpi). Multiple nozzle rows (nozzle groups) in which the nozzles 32 are arranged are provided in the nozzle plate 26, and each nozzle row is configured of, for example, 180 nozzles 32.

Figure 4:
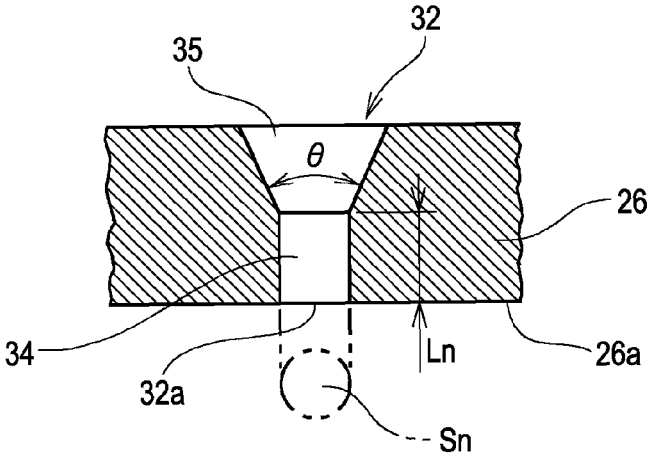
FIG. 4 is a cross-sectional view illustrating the configuration of a nozzle.

FIG. 4 is a cross-sectional view of the nozzle 32. As shown in FIG. 4, the nozzle 32 is provided with a circular nozzle opening 32*a* at the tip of the nozzle 32, or in other words, in a nozzle surface 26*a* of the nozzle plate 26 that opposes the recording paper 6; ink is ejected from this nozzle opening 32*a*. Meanwhile, a cylindrical nozzle straight portion 34 is formed toward the pressurizing chamber 30 from the nozzle opening 32*a* so that the cross-sectional area of the nozzle straight portion 34 is smaller than the other areas within the nozzle 32, and a nozzle taper portion 35 whose cross-sectional area progressively increases toward the pressurizing chamber 30 is formed more toward the pressurizing chamber 30 than the nozzle straight portion 34 so as to communicate with the nozzle straight portion 34. The angle of aperture θ of the nozzle straight portion 34 is set so as to be greater than or equal to 40 degrees.

The vibrating plate 27 has a dual-layer structure in which an elastic film 39 has been layered upon a support plate 38. In this embodiment, the vibrating plate 27 is created using a complex plate material, in which a stainless steel plate, which is a type of metallic plate, is used as the support plate 38, and a resin film, serving as the elastic film 39, is laminated to the surface of the support plate 38. A diaphragm portion 40 that causes the volume of the pressurizing chamber 30 to change is provided in the vibrating plate 27. Furthermore, a compliance portion 41 that partially seals the reservoir 28 is provided in the vibrating plate 27.

The diaphragm portion 40 is created by partially removing the support plate 38 through an etching process or the like. In other words, the diaphragm portion 40 includes an island portion 42 that is affixed to the tip surface of the free end of the piezoelectric vibrator 20, and a thin elastic portion 43 that surrounds this island portion 42. The compliance portion 41 is created by removing the support plate 38 from the region opposite to the opening surface of the reservoir 28 using the same type of etching process as with the diaphragm portion 40, and functions as a damper that absorbs pressure fluctuations in the liquid held within the reservoir 28.

The tip surface of the piezoelectric vibrator 20 is affixed to the island portion 42, and the volume of the pressurizing chamber 30 can be changed by causing the free end of the piezoelectric vibrator 20 to expand and contract. To be more specific, the piezoelectric vibrator 20 in the longitudinal vibration mode contracts in the lengthwise direction of the vibrator when charged, and expands in the lengthwise direction of the vibrator when discharged. Accordingly, when the potential of the vibrator rises due to a charge, the island portion 42 is pulled toward the piezoelectric vibrator 20; as a result, the thin elastic portion 43 surrounding the island portion 42 deforms and the pressurizing chamber 30 expands. On the other hand, the pressurizing chamber 30 contracts when the potential of the vibrator drops due to a discharge. A pressure change then occurs in the ink within the pressurizing chamber 30 as a result of the change in the volume of the pressurizing chamber 30, and the ink is ejected from the nozzle opening 32*a* of the nozzle 32 using this pressure change.

Next, a configuration implemented in the stated printer 1 for ejecting a high-viscosity ink such as light-curable ink (a type of "high-viscosity liquid") will be described. When ejecting high-viscosity ink using the stated printer 1, the ink tends to move less easily in the nozzle 32 and be more difficult to eject from the nozzle opening 32*a* than when ejecting a low-viscosity ink. Meanwhile, when a pressure change occurs in the pressurizing chamber 30, the ink within the pressurizing chamber 30 flows more toward the ink supply channel 29 than the nozzle 32 (to rephrase, the ink is more susceptible to backflow into the ink supply channel 29), and in such a case, the ink cannot be efficiently ejected from the nozzle 32. Accordingly, the inertance Mn of the nozzle 32 is set to be lower than the inertance Ms of the ink supply channel 29 (Mn<Ms). "Inertance" indicates how easily the ink within the ink flow channel will move, and is the ink mass per unit of cross-sectional area. The inertances M can be approximated through the following Equation (1), taking the ink density as ρ, the cross-sectional area of the surface orthogonal to the direction of the ink flow within the flow channel as S, and the length of the flow channel as L.

$$\text{inertance } M = (\text{density } \rho \times \text{length } L)/\text{cross-sectional area } S \quad (1)$$

Figure 5:
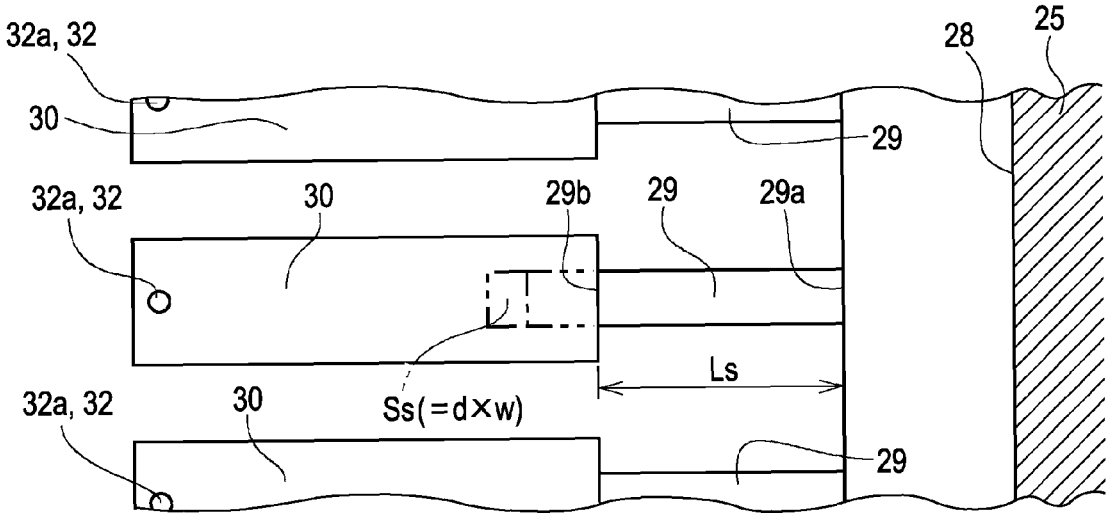
FIG. 5 is a schematic view illustrating an ink flow channel from a reservoir to a nozzle, as viewed along the V-V line in FIG. 2.

The quality of the ejection state of high-viscosity ink is also affected by the balance between resistance when the ink moves within the nozzle 32 and resistance when the ink moves (backflows) within the ink supply channel 29. In light of this point, the inventors investigated the influence that the relationship between the dimensions of the nozzle 32 and the dimensions of the ink supply channel 29 has on the ejection state of high-viscosity ink. To be more specific, first, as shown in FIG. 4, the cross-sectional area of the opening of the nozzle straight portion (that is, the minimum cross-sectional area of the opening in the nozzle 32) is taken as a straight surface area Sn, and the length of the nozzle straight portion 34 is taken as a straight length Ln, for the nozzle 32. Meanwhile, with respect to the ink supply channel 29, as shown in FIG. 5, the channel cross-sectional area of the ink supply channel 29 is taken as a supply channel surface area Ss, and the length from a reservoir-side connection opening 29*a* of the ink supply channel 29 (this corresponds to a "common liquid chamber-side connection opening" according to the invention) to a pressurizing chamber-side connection opening 29*b* is taken as a supply channel length Ls. The behavior of the state in which ink is ejected from the nozzle opening 32*a* was then examined while changing the straight surface area Sn, the straight length Ln, and the supply channel length Ls. Note that the viscosity of the ink within the pressurizing chamber 30 is set to 8 mPa·s, and the ink supply channel 29 is set to have a rectangular cross-section with a depth d of 80 μm and a width w of 60 μm.

FIG. 6 is a table illustrating determinations as to the quality of ink ejection states when the dimensions of the nozzle straight portion 34 (the diameter of the nozzle opening 32*a* and the straight length Ln) and the supply channel length Ls of the ink supply channel 29 are changed. In this table, a "○" indicates that the impact shape upon the printing surface of the recording paper 6 is a permissible shape, and that the ejection efficiency is favorable (that is, within a pre-set permissible range). Note that the "permissible shape" includes, in addition to the ideal circular impact shape for ink droplets, elliptical shapes, gourd shapes, and so on caused by the occurrence of trailing tails, satellite droplets, and so on, as long as the distortion resulting in those shapes is of a degree that does not cause problems in terms of image quality in the recorded image. Meanwhile, a "Δ" indicates the case where the ejection efficiency is favorable, but long trailing tails have occurred, resulting in the risk of negative influence on the image quality of the recorded image. Finally, an "x" indicates that the ejection efficiency is unacceptable regardless of whether or not the impact shape of the ink droplet is favorable.

As can been in FIG. 6, when the straight length Ln of the nozzle straight portion 34 is the shortest length, or 15 μm, an ink droplet ejection result indicated by a "○" is obtained regardless of the size of the diameter of the nozzle opening 32*a* (or in other words, the straight surface area Sn) and the length of the supply channel length Ls. This is thought to be because the influence of resistance on the ink by the nozzle straight portion 34 is suppressed to less than the resistance on the ink by the ink supply channel 29, and as a result, even high-viscosity ink that is greater than or equal to 8 mPa·s can move easily within the nozzle straight portion 34. However, when the straight length Ln of the nozzle straight portion 34 is the maximum length of 30 μm, an ink droplet ejection result indicated by a "Δ" or an "x" is obtained regardless of the size of the diameter of the nozzle opening 32*a* (the straight surface area Sn) and the length of the supply channel length Ls, and thus a favorable ink droplet ejection state cannot be achieved.

Furthermore, examinations based on the judgment of the quality of the ejection states illustrated in FIG. 6 demonstrated that ejection results indicated by a "○" could be achieved if the ratio of the straight length Ln to the straight surface area Sn (Ln/Sn) is set to ½ or less than the ratio of the supply channel length Ls to the supply channel surface area Ss (Ls/Ss). In other words, if the following Equations (2) and (3) are fulfilled, problems in which trailing tails, mist, or the like occur can be suppressed even if high-viscosity ink is used, and thus an impact shape of ink droplets on the recording paper 6 that is closer to an ideal shape can be realized.

$$Mn<Ms \tag{2}$$

$$Ln/Sn \leqq (Ls/Ss)/2 \tag{3}$$

Accordingly, a sense of graininess (where fine dots appear visible throughout the image) visually perceived by a viewer of a recorded image that has been recorded onto the printing surface of the recording paper 6 can be suppressed, which can contribute to an improvement in the image quality. In addition, the channel resistance in the nozzle 32 is not increased, thus making it possible to avoid an increase in pressure loss in the ink when ejecting the ink from the nozzle 32 and, by extension, a dramatic drop in the efficiency of operations when ejecting ink (that is, the ejection efficiency).

Meanwhile, the nozzle taper portion 35 is provided more toward the pressurizing chamber 30 than the nozzle straight portion 34 in the nozzle 32, and the angle of aperture θ of the nozzle taper portion 35 is set to 40 degrees or more, which makes it possible to conduct the ink from the pressurizing chamber 30 into the nozzle straight portion 34 in a smooth manner, thus making it possible to achieve an improvement in the ink ejection efficiency. Furthermore, if the viscosity of the ink in the pressurizing chamber 30 is greater than or equal to 8 mPa·s, a problem in which the ink droplet spreads out excessively upon the recording paper 6 can be suppressed, thus making it possible to achieve an ink droplet impact shape that is even closer to an ideal state. Such ink droplets are also less prone to bleeding on the recording paper 6, which makes it possible to suppress the occurrence of unevenness in the darkness of the recorded image.

Note that the invention is not limited to the above-described embodiment, and many variations based on the content of the appended claims are possible. For example, the invention is not limited to high-viscosity ink as indicated in the aforementioned embodiment, and is also useful when ejecting other high-viscosity liquids, such as liquid crystals, electrode materials, and so on.

Figure 7A:
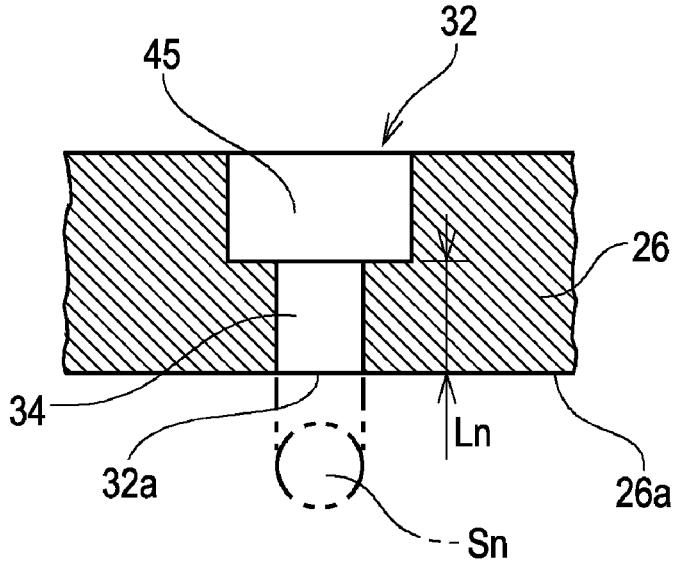
FIGS. 7A and 7B are cross-sectional views illustrating the configuration of a nozzle according to a variation.
Figure 7B:
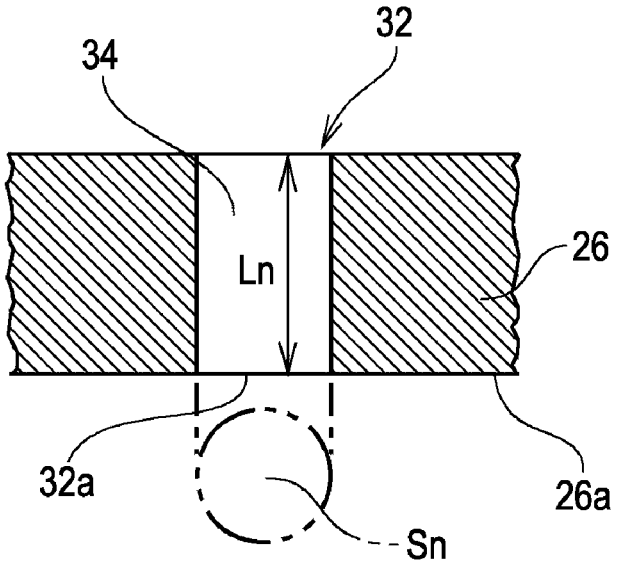

Furthermore, although the aforementioned embodiment described an example of the nozzle 32 provided with the nozzle taper portion 35, the invention is not limited thereto. Essentially, any nozzle may be employed as long as the cylindrical nozzle straight portion 34 whose opening cross-sectional area is set to be narrower than the other areas of the nozzle is provided toward the pressurizing chamber 30 from the nozzle opening 32*a* in the nozzle. For example, as shown in FIG. 7A, a nozzle conduction portion 45 having a cylindrical shape and whose opening cross-sectional area is wider than the nozzle straight portion 34 may be provided more toward the pressurizing chamber 30 than the nozzle straight portion 34 in the nozzle 32. Alternatively, as shown in FIG. 7B, the nozzle 32 may be configured solely of the cylindrical nozzle straight portion 34. In this case, the overall length of the nozzle 32 is the straight length Ln, and the opening cross-sectional area of the nozzle 32 is the straight surface area Sn.

Furthermore, although a so-called longitudinal vibration piezoelectric vibrator 20 is described as an example of a pressure generation unit in the aforementioned embodiments, it should be noted that the pressure generation unit is not limited thereto, and, for example, a so-called flexural vibration piezoelectric vibrator can be employed as well.

Finally, the invention is not limited to a printer, and can be applied in any liquid ejecting apparatus capable of ejecting a liquid held in a pressurizing chamber from a nozzle opening at the tip of a nozzle, such as a plotter, a facsimile apparatus, a copy machine, or the like; various types of ink jet recording apparatuses; liquid ejecting apparatuses aside from recording apparatuses, such as, for example, display manufacturing apparatuses, electrode manufacturing apparatuses, chip manufacturing apparatuses; and so on. In such display manufacturing apparatuses, liquids having R (red), G (green), and B (blue) coloring materials are ejected from coloring material ejecting heads. Meanwhile, in electrode manufacturing apparatuses, electrode materials are ejected in liquid form from electrode material ejection heads. In chip manufacturing apparatuses, bioorganic matters are ejected in liquid form from bioorganic matter ejection heads.

What is claimed is:

1. A liquid ejecting head comprising:

multiple nozzles from which a liquid is ejected;

pressurizing chambers communicating with respective nozzles; and liquid supply channels that supply the liquid from a common liquid chamber to the respective pressurizing chambers, the liquid ejecting head ejecting the liquid held in the pressurizing chambers from nozzle openings in the tips of the nozzles when a change in the pressure within the pressurizing chambers is instigated by driving a pressure generation unit, wherein the inertance of the nozzles is set to be less than the inertance of the liquid supply channels;

a cylindrical nozzle straight portion, in which the opening cross-sectional area is set to be narrower than the other areas of the nozzle, is formed toward the pressurizing chamber from the nozzle opening in each nozzle;

the opening cross-sectional area of the nozzle straight portion is a straight surface area Sn;

the length of the nozzle straight portion is a straight length Ln;

the channel cross-sectional area of the liquid supply channel is a supply channel surface area Ss;

the length from a common liquid chamber-side connection opening in the liquid supply channel to a pressurizing chamber-side connection opening is a supply channel length Ls; and the ratio of the straight length Ln to the straight surface area Sn (Ln/Sn) is set so as to be less than or equal to ½ of the ratio of the supply channel length Ls to the supply channel surface area Ss (Ls/Ss).

2. The liquid ejecting head according to claim 1, wherein a nozzle taper portion whose opening cross-sectional area progressively increases in the direction of the pressurizing chamber more toward the pressurizing chamber than the nozzle straight portion in the nozzle is formed so as to communicate with the nozzle straight portion; and the angle of aperture of the nozzle taper portion is set to be greater than or equal to 40 degrees.

3. The liquid ejecting head according to claim 1, wherein the viscosity of the liquid in the pressurizing chamber is greater than or equal to 8 mPa·s.

4. A liquid ejecting apparatus comprising:

a liquid ejecting head including:

multiple nozzles from which a liquid is ejected;

pressurizing chambers communicating with respective nozzles; and liquid supply channels that supply the liquid from a common liquid chamber to the respective pressurizing chambers, the liquid ejecting head ejecting the liquid held in the pressurizing chambers from nozzle openings in the tips of the nozzles when a change in the pressure within the pressurizing chambers is instigated by driving a pressure generation unit, wherein the inertance of the nozzles is set to be less than the inertance of the liquid supply channels;

a cylindrical nozzle straight portion, in which the opening cross-sectional area is set to be narrower than the other areas of the nozzle, is formed toward the pressurizing chamber from the nozzle opening in each nozzle;

the opening cross-sectional area of the nozzle straight portion is a straight surface area Sn;

the length of the nozzle straight portion is a straight length Ln;

the channel cross-sectional area of the liquid supply channel is a supply channel surface area Ss;

the length from a common liquid chamber-side connection opening in the liquid supply channel to a pressurizing chamber-side connection opening is a supply channel length Ls; and the ratio of the straight length Ln to the straight surface area Sn (Ln/Sn) is set so as to be less than or equal to ½ of the ratio of the supply channel length Ls to the supply channel surface area Ss (Ls/Ss).

5. The liquid ejecting apparatus according to claim 4, wherein a nozzle taper portion whose opening cross-sectional area progressively increases in the direction of the pressurizing chamber more toward the pressurizing chamber than the nozzle straight portion in the nozzle is formed so as to communicate with the nozzle straight portion; and the angle of aperture of the nozzle taper portion is set to be greater than or equal to 40 degrees.

6. The liquid ejecting apparatus according to claim 4, wherein the viscosity of the liquid in the pressurizing chamber is greater than or equal to 8 mPa·s.

* * * * *